US008348143B2

(12) United States Patent
Mohda et al.

(10) Patent No.: US 8,348,143 B2
(45) Date of Patent: Jan. 8, 2013

(54) CONTAINER

(75) Inventors: Asit Mohda, Uxbridge (GB); William John Davis, Bath (GB)

(73) Assignee: Cadbury Holdings Limited (GB)

( * ) Notice: Subject to any disclaimer, the term of this patent is extended or adjusted under 35 U.S.C. 154(b) by 304 days.

(21) Appl. No.: 12/518,481

(22) PCT Filed: Nov. 29, 2007

(86) PCT No.: PCT/GB2007/004578

§ 371 (c)(1),
(2), (4) Date: Jan. 6, 2010

(87) PCT Pub. No.: WO2008/071907

PCT Pub. Date: Jun. 19, 2008

(65) Prior Publication Data

US 2010/0108751 A1 May 6, 2010

(30) Foreign Application Priority Data

Dec. 15, 2006 (GB) ..... 0625011.2

(51) Int. Cl.

| | |
|---|---|
| ***B65D 17/28*** | (2006.01) |
| ***B65D 43/08*** | (2006.01) |
| ***B31B 49/02*** | (2006.01) |
| ***B31B 3/26*** | (2006.01) |

(52) U.S. Cl. ..... 229/223; 220/810

(58) Field of Classification Search ..... 229/223, 229/87.14, 87.13, 217, 219, 185.1, 130, 131, 229/142, 231, 234, 221, 222, 225, 228, 229, 229/232, 233, 230, 224, 226; 206/242; 222/460, 222/462, 461, 196.2

See application file for complete search history.

(56) References Cited

U.S. PATENT DOCUMENTS 1,847,028 A 2/1932 Townsend
2,202,280 A * 5/1940 Wilson ..... 206/264

(Continued)

FOREIGN PATENT DOCUMENTS

DE 3832544 3/1990

(Continued)

*Primary Examiner* — Nathan J Newhouse
*Assistant Examiner* — Christopher Demeree
(74) *Attorney, Agent, or Firm* — Hoffman & Baron, LLP

(57) ABSTRACT

A confectionery container (11) is constructed from one or more pieces of foldable material (10, FIG. 1). A first end is closed by a wall (32) incorporating at least part of a dispensing chute (35) movable between an open position for the dispensing of items and a closed position for the containment of items within the container. The first end wall (32) comprises two or more end closure flaps (28, 29) arranged such that they can be assembled into the first end wall after the items have been introduced into a partially formed container through the first end (32). The chute (35) may have a base (36) and a pair of side walls (12*a*, 14*a*), at least one of the side walls (12*a*, 14*a*) having a leading edge (39) which contacts a side wall (55) of the container to limit opening movement of the chute. The container (11) is preferably formed from a unitary blank (10, FIG. 1) and the container side walls may have inner panels (12, 13, 14, and 15) and outer panels (16, 17, 18, and 19). A method of constructing the container is also disclosed.

38 Claims, 2 Drawing Sheets

U.S. PATENT DOCUMENTS

| | | | | |
|---|---|---|---|---|
| 2,627,972 | A * | 2/1953 | Roos | 206/731 |
| 2,886,233 | A | 5/1959 | Kessler | |
| 3,048,324 | A * | 8/1962 | Anderson | 229/207 |
| 3,227,329 | A * | 1/1966 | Kersh et al. | 222/363 |
| 5,325,989 | A | 7/1994 | Karalus | |
| 2003/0098344 | A1 * | 5/2003 | Blake | 229/122.1 |

FOREIGN PATENT DOCUMENTS

| | | |
|---|---|---|
| JP | 08 230873 | 9/1996 |
| JP | 10 35645 | 2/1998 |
| WO | WO 02/30765 | 4/2002 |
| WO | WO 2005/082745 | 9/2005 |

* cited by examiner

CONTAINER

CROSS-REFERENCE TO RELATED APPLICATIONS

This application is the National Stage of International Application No. PCT/GB2007/004578, which designates the U.S., filed Nov. 29, 2007, which claims the benefit of GB 0625011.2, filed Dec. 15, 2006, the contents of which are incorporated by reference herein.

FIELD OF THE INVENTION

This invention is concerned with containers, particularly, although not exclusively, containers for the containment and dispense of items in pellet or tablet form or the like, such as confectionery items or tablet form medications. The invention also relates to a blank for forming such a container and to a method for constructing and filling such a container.

BACKGROUND OF THE INVENTION

It is known to provide a container which is formed from one or more sheets of foldable material. The material is folded into shape and various parts are adhered to one another so that the shape is retained. Often, such containers are formed from a single unitary blank of foldable material. It is also known for such containers to comprise a hinged chute which in a closed position forms part of a wall of the container but which is movable to an open position in which it provides a chute, through which the contents of the container may be dispensed.

In the known containers, the chute is often provided in a first, usually upper end. However, the design of the known containers is such that they have to be filled through the opposite, usually lower end. This may require a part assembled container to be turned to position the opposite end uppermost, so that the contents can be deposited into the container. The opposite end is then closed by means of an end closure which typically comprises foldable end flaps and tabs. The need to invert the partially constructed container is time consuming and can introduce inaccuracies in the assembly process.

Furthermore, such known containers typically use abutments as means to restrict movement of the chute in the opening direction. However, the known restriction means can become unreliable with repeated use.

An object of the invention is to provide a container suitable for the containment and dispense of small items such as confectionery items or tablet-form medications which is simple to assemble and convenient to fill.

It is a further object of the invention to provide a container having an improved opening and closing chute arrangement for the dispensing of such items.

Another object of the invention is to provide a blank for the manufacture of a container with the abovementioned attributes.

Still another object of the invention is to provide a method of constructing and filling a container with the above mentioned attributes.

SUMMARY OF THE INVENTION

According to a first aspect of the invention, there is provided a confectionery container constructed from one or more pieces of foldable material, the container having a first end closed by a which incorporates at least part of a dispensing chute movable between an open position for the dispensing of items and a closed position for the containment of items within the container, wherein the first end wall comprises two or more end closure flaps arranged such that they can be assembled into the first end wall after the items to be contained and dispensed have been introduced into a partially formed container through the first end.

A container in accordance with the first aspect of the invention can be partially formed and the contents introduced through the open first end. The end closure flaps can then be folded and secured in position to close the first end of the container. This enables the container, including the chute, to be fully machine assembled without the need to invert the container for filling though an end opposite from the end in which the chute is provided.

The chute may comprise a base and two side walls which project inwardly from opposing sides of the base, the base forming at least part of the first end wall.

In accordance with a second aspect of the invention, there is provided a confectionery container constructed from one or more pieces of foldable material, the container having a first end closed by a wall which incorporates at least part of a dispensing chute movable between an open position for the dispensing of items and a closed position for the containment of items within the container, wherein the chute comprises a base and side walls, and at least one side wall of the chute is arranged to contact a side wall of the container to limit movement of the chute in the opening direction.

A container in accordance with the second aspect of the invention is simple to construct and provides a reliable chute mechanism for the dispensing of items.

The limiting relationship may be provided by the configuration of the at least one side wall of the chute. The at least one side wall may have a leading edge for cooperating with said side wall of the container. The leading edge may comprise a first curved region extending from an end adjacent the base of the chute to an intermediate position part way along the edge and a second region having a different profile extending beyond the intermediate position towards a distal end, the arrangement being such that, in use when the cute is opened, the first curved region moves past an inner surface of the side wall of the container during an initial permitted range of movement of the chute in the opening direction, the second region of the edge subsequently contacting the inner surface of the side wall of the container to limit the opening movement of the chute beyond the permitted range. The second region of the leading edge may be generally linear and may be configured such that when the chute is closed it is angled inwardly away from the side wall of the container. The leading edge may also be configured so that when the chute is at the limit of its permitted movement in the opening direction, the second region extends generally parallel to and in contact with the side wall of the container. Both side walls of the chute may comprise a leading edge which cooperates with the side wall of the container to limit opening movement of the chute.

The following advantageous features are applicable to both the first and second aspects of the invention.

The base of the chute may comprise only part of the first end wall and may be connected with the remainder of the first end wall by a fold line about which the chute pivots between the open and closed positions.

The first end wall may comprise a pair of end closure flaps, each flap being pivotably connected to a respective one of a pair of opposing side walls of the container by a fold line. The confectionery container may have a first pair of opposing side walls and a second pair of opposing side walls, at least the first pair of opposing side walls having an inner panel and an outer panel. Each of the end closure flaps may be attached by a fold line to a respective inner panel of the first pair of opposing side walls. Each side wall of the chute may comprise a portion of one of the inner panels. Each panel portion may be separably connected with the remainder of its respective inner panel by means of perforations. The remaining portions of the inner panels may be adhered to their respective outer panels. Each panel portion may be connected with a part of a respective one of the end closure flaps which forms the base of the chute by a fold line. At least one of the second pair of opposing side walls may also comprise an inner panel and an outer panel.

The container may be shaped like a rectangular prism in which the first pair of opposing side walls are wider or longer than the second pair of opposing side walls.

The first end wall may further comprise an end closure tab connected by means of a fold line with a panel forming at least part of a further side wall of the container.

The container and chute may be formed integrally from a unitary blank.

In accordance with a third aspect of the invention, there is provided a blank for forming a confectionery container in accordance with the first aspect of the invention and/or the second aspect of the invention.

The blank may comprise a pair of end closure flaps attached by means of fold lines with respective panels comprising at least part of opposing side walls of the container, the end closure flaps forming at least part of the first end wall of the container when the container is assembled.

The first end wall may further comprise an end closure tab connected with a further panel forming at least part of a further side wall of the container.

The blank may comprise panel portions which form the side walls of the chute. Each panel portion may be connected by a fold line with at least part of a respective one of the end closure flaps. At least one of the panel portions may have a leading edge for cooperating with an inner surface of a side wall of the finished container to limit opening movement of the chute. The, or each, leading edge may have a first curved region extending from an end adjacent the end closure flap to an intermediate position part way along the edge and a second region having a different profile extending beyond the intermediate position towards a distal end. The second region of the leading edge may be generally linear. Each panel portion may be part of an inner panel forming a side wall of the assembled container and the blank may further comprise outer panels which are arranged to overlie the inner panels when the container is assembled. Each panel portion may be separably connected with a remaining portion of its inner panel by means of perforations. Each inner panel may comprise a region of adhesive which covers at least part of an outer surface of the remaining portion.

The blank may comprise a series of eight panels connected by fold lines between adjacent panels, the arrangement being such that the panels can be folded about the fold lines to form two pairs of opposing side walls, each side wall having an inner panel and an outer panel overlying its respective inner panel.

In accordance with a fourth aspect of the invention, there is provided a method of constructing a confectionery container from one or more pieces of foldable material, the container having a first end closed by a wall which incorporates at least part of a dispensing chute movable between an open position for the dispensing of items and a closed position for the containment of items within the container, wherein the first end wall comprises two or more end closure flaps, the method comprising, assembling the container to form all the walls of the container except the first end wall, such that the partially formed container defines a receptacle in to which the contents can be inserted through the open first end; subsequently assembling the end flaps to close the first end of the container.

The partially formed container may have four side walls and a second end wall at the end of the container opposite from the first end wall.

The method may further comprise introducing items to be contained and dispensed into the partially formed container before the end closure flaps are assembled to close the first end.

During the assembly and filling process, the first end may remain uppermost at least until the first end wall has been formed.

The assembly and filling of the container may be carried out by machine.

The container may be formed from a single unitary blank. In which case, the method may include folding the blank to form two pairs of opposing side walls and securing in position; folding further end closure flaps and/or tabs to close a second end of the container opposite from the first end and securing in position; introducing items to be contained and dispensed into the partially formed container through the open first end; subsequently folding the first end closure flaps and securing in position to close the first end.

The first end wall of the container may further comprise an end closure tab connected by means of a fold line with a panel forming at least part of a side wall, and the step of closing the first end may further comprise folding the end closure tab into position. The end closure tab may be folded into position before the end closure flaps are folded into position.

BRIEF DESCRIPTION OF THE DRAWINGS

The various aspects of invention will now be described by way of the accompanying drawings in which.

DETAILED DESCRIPTION OF PREFERRED EMBODIMENTS

Figure 1:
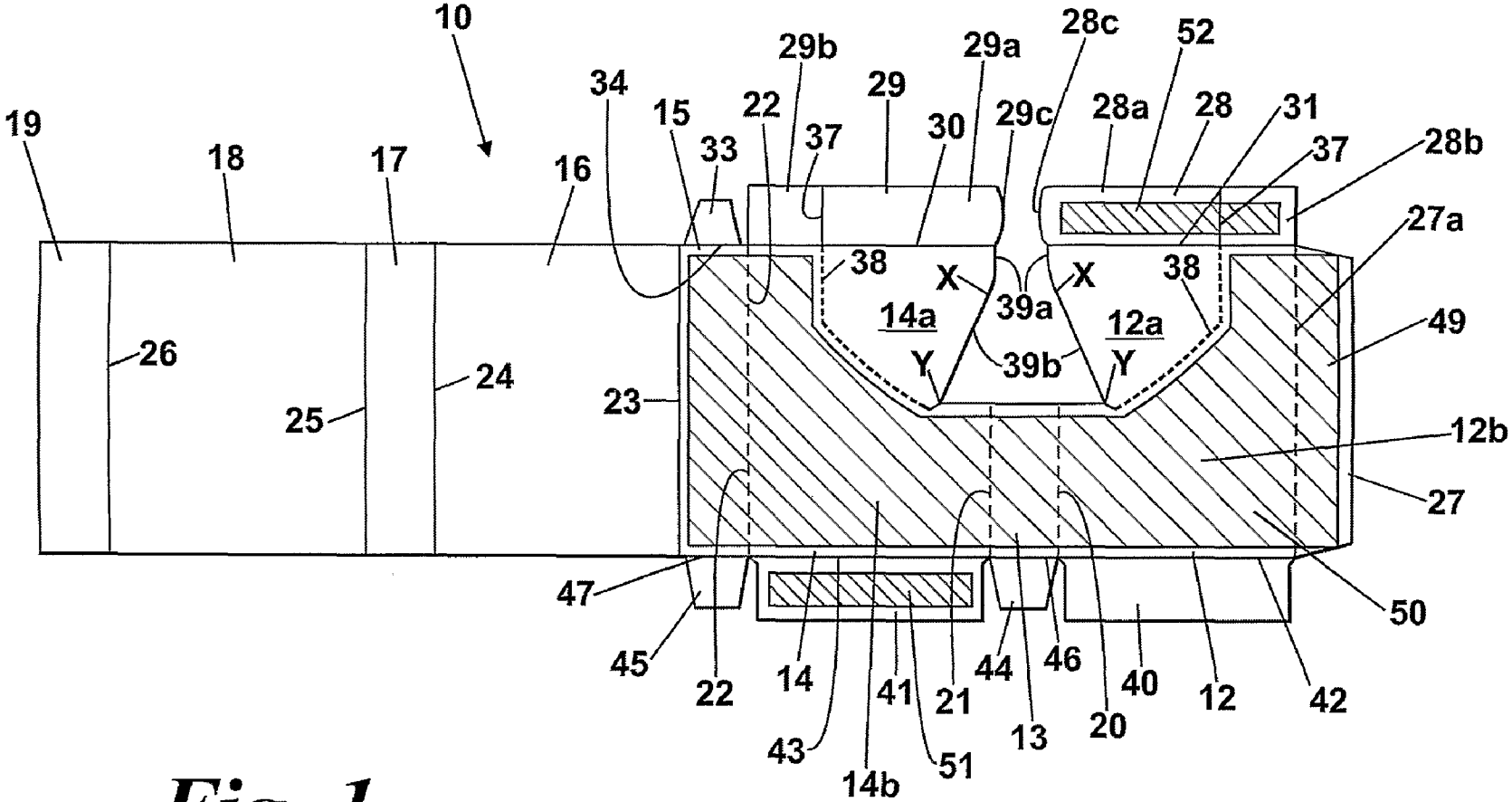
FIG. 1 is a plan view of a unitary blank for a container according to the invention.

As shown in FIG. 1, a unitary blank 10 for a container 11 in accordance with the invention comprises a series of panels 12 to 19, foldably interconnected by fold lines 20 to 26. A side tab 27 is foldably connected to an edge of the panel 12 by fold line 27*a* to assist in construction of the container 11 as will be described in more detail below.

The blank 10 includes a first pair of end closure flaps 28, 29 which are attached to a first end of the panels 12 and 14 respectively by fold lines 30, 31. The first pair of end closure flaps 28, 29 form a first end wall 32 of the container 11 together with a tab 33, which is attached to a first end of the panel 15 by fold line 34. The first end wall 32 includes a dispensing chute 35 for the container, with a first region 28*a*, 29*a* of the each of the end closure flaps 28, 29 forming a base 36 of the chute in the assembled dispenser. The first regions 28*a*, 29*a* of each flap 28, 29 are connected with the reminder 28*b*, 29*b* of the flap by fold lines 37. Portions 12*a*, 14*a* of the panels 12 and 14 comprise side walls of the chute 35 in the finished container and are separably connected with the remaining panel portions 12*b*, 14*b* by a line of perforations 38. Each of the panel portions 12*a*, 14*a* remain connected to the first region 28*a*, 29*a* of their respective end closure flap 28, 29 via the fold lines 30, 31.

A leading edge 39 of each of the panel portions 12*a*, 14*a* is shaped so as to have a first region 39*a* extending from an end of the panel portion adjacent its respective end closure flap 28, 29 to an intermediate position X and a second region 39*b* extending from the intermediate position to a distal end Y of the panel portion. The first region 39*a* is curved and may in particular be arcuate, whereas the second region 39*b* is substantially linear. The leading edges 39 are configured to cooperate with a side wall of the finished container to limit opening movement of the chute 35 as will be described in detail below.

It should be noted that the leading ends 28*c*, 29*c* of the end closure flaps 28, 29 which form the first end wall of the container project beyond the fold lines 20, 21 which separate the respective panels 12, 14 from the panel 13. As a result, the free ends 28*c*, 29*c* of the flaps project beyond a side wall of the container defined by the panels 13 and 17 when the container is formed to provide a lip 35*a* by means of which the chute 35 can be lifted by an end user. The leading ends 28*c*, 29*c* are curved.

A second pair of end closure flaps 40, 41 are connected to a second end of the panels 12, 14 opposite from the first by fold lines 42, 43. A pair of end closure tabs 44, 45 are connected to the second end of panels 13 and 15 respectively by fold lines 46 and 47. The second pair of end closure flaps 40, 41 and the end closure tabs 46, 47 form a second end wall 48 of the container in a conventional manner.

To form the container 11, the panels 12 to 19 are folded about the fold lines 20 to 26 to provide the side walls of a container having a generally rectangular prism shape, in which each side wall has an inner panel and an outer panel. The panels 12 to 15 form the inner set of panels whilst the panels 16 to 19 form an outer set of panels which overlie the inner set. Thus, the inner panels 12 to 15 are folded about fold lines 20 to 22 to form a generally rectangular prism shape and the side tab 27 is affixed to the inner surface of the panel 15 using adhesive to hold the inner panels in position. The adhesive may be pre-applied to an outer surface of the tab 27 as indicated at 49. Alternatively, the adhesive 49 may be pre-applied the inner surface of the panel 15 or it may be applied during the assembly process. The outer panels 16 to 19 are then wrapped around the inner panels so that outer panel 16 overlies inner panel 12, outer panel 17 overlies inner panel 13, outer panel 18 overlies inner panel 14 and outer panel 19 overlies inner panel 15. The inner and outer panels are affixed to each other using an adhesive. The adhesive for securing the inner and outer panels together may be pre-applied to the outer surface of the inner panels as indicated at 50 or it may be pre-applied to the inner surfaces of the outer panels or a combination of the two. The adhesive may also be applied during the assembly process. The adhesive is not applied to panel portions 12*a*, 14*a* which remain free to move relative to their respective outer panels 16, 18 once they have been separated from the remaining portions 12*b*, 14*b* of the inner panels 12, 14 by tearing along the lines of perforations 38 as discussed below.

The second end closure wall 48 of the container is then formed to close the second end of the container, which is usually the bottom end. Thus the tabs 46, 47 are folded inwardly followed by the end closure panels 40 and 41 in a conventional way. An inner one of the end closure panels 41 has a region of adhesive 51 on its outer surface so the two end closure flaps are firmly secured to one another closing the bottom end of the container.

The partially constructed container provides a rectangular prism shaped box having a closed second or bottom end into which the contents to be dispensed can be introduced through the open first or upper end.

Once the contents have been introduced, the container 11 can be completed by forming the first end wall 32 to close the upper end. Thus the tab 33 is folded inwardly followed by the first end closure flaps 28, 29. An inner one of the end closure flaps 28 has a region of adhesive 52 on its outer surface for contact with the inner surface of the outer flap 29 to bond the two flaps 28, 29 together.

The basic container 11 is now fully formed and comprises a fully enclosed rectangular prism shaped box which holds the contents to be dispensed. Depending on the application, the container 11 may be subject to further manufacturing processes such as the application of an outer wrapper.

The container 11 as constructed above has two pairs of opposing side walls, a first pair 53, 54 and a second pair 55, 56. As the container 11 in accordance with the present embodiment is rectangular, the first pair of opposing side walls 53, 54 are wider or longer than the second pair 55, 56. However, the container could be arranged to have alternative shapes, such as a square prism, in which case the two pairs of opposing side walls could have the same width. The end closure flaps 28, 29; 40, 41 are attached to the inner panels 12, 14 which from the first pair of opposing side walls 53, 54. Whilst the end closure tabs 33, 46, 47 are attached to the inner panels which form the second pair of opposing walls 55, 56. In an alternative arrangement, the end closure panels 40, 41 and tabs 46, 47 which form the second end closure wall 48 could be attached to the outer panels 16, 18, 17, 19.

To open the container 11, a user applies an upward force to the lip 35*a* of the chute which causes the chute to pivot about the fold line 37. During the first opening of the chute 35, the panel portions 12*a*, 14*a* which form the side walls of the chute are torn from the remaining portions 12*b*, 14*b* of the inner panels 12, 14 along the lines of perforation 38. In certain applications, the panel portions 12*a*, 14*a* may be separated from the remaining portions 12*b*, 14*b* of the inner panels 12, 14 as part of the assembly process in forming the container 11. This may be particularly so where the container is to be wrapped in an outer wrapper.

Figure 2:
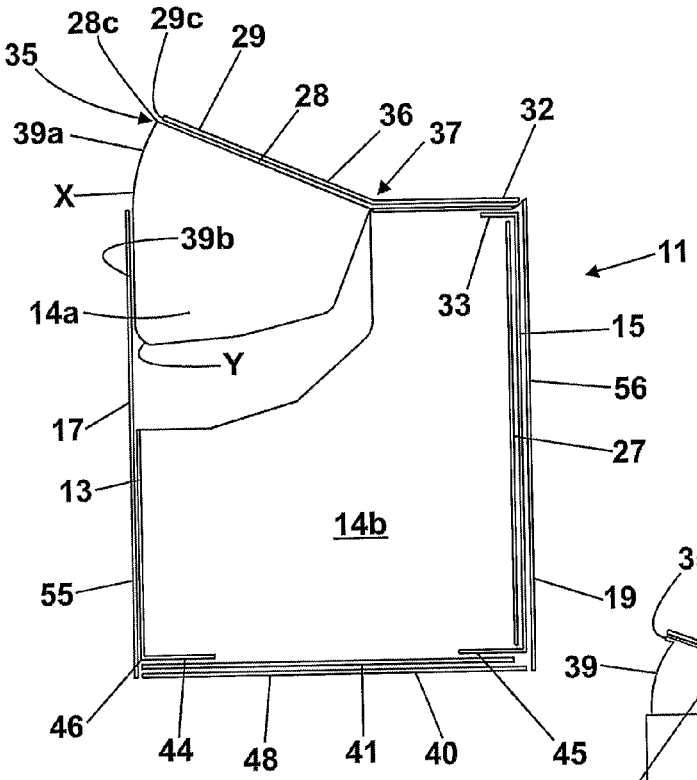
FIG. 2 is a cross-sectional diagrammatic side view of a container in accordance with the invention formed from the blank of FIG. 1 in an open arrangement.
Figure 3:
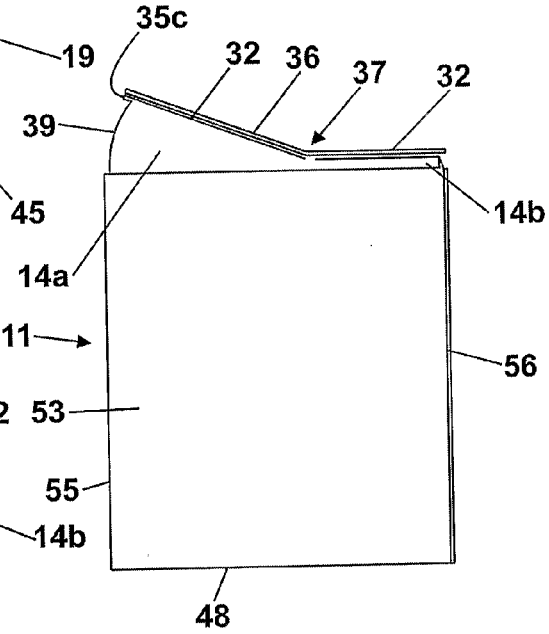
FIG. 3 is a diagrammatic side view of the container of FIG. 2.
Figure 4:
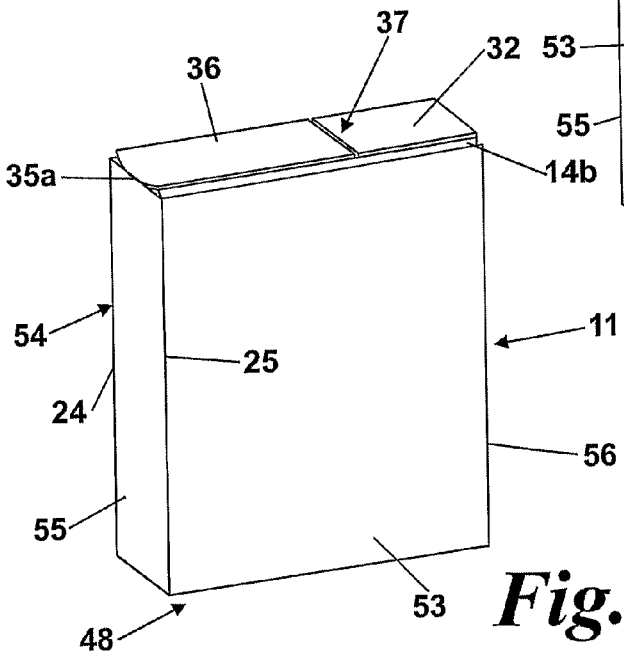
FIG. 4 is a perspective view of the container of FIG. 2 in a closed arrangement.

Once the panel portions 12*a*, 14*a* have become detached, the chute 35 is pivoted about the fold line 37 to the open position as shown in FIGS. 2 and 3. With the chute open, items in the container can be dispensed through the chute 35. Where the contents are in pellet form, such as chewing gum pellets for example, the container may have to be inverted and tapped or shaken as required to dislodge the pellets into the chute 35.

The opening movement of the chute 35 is limited through contact of the leading edges 39 of the panel portions 12*a*, 14*a* which the inner surface of the panel 17, which forms the outer panel of one of the side walls 55, which in this case can be considered as a front wall. Over an initial range of movement of the chute 35 in an opening direction, the first curved regions 39*a* of the leading edges 39 are able to move past the inner surface of the panel 17 to allow the chute to open. However, once the chute has moved through the permitted initial range of movement, the second, generally linear regions 39*b* of the leading edges come into abutment with the inner surface of the panel 17, preventing further movement of the chute 35 in the opening direction. The range of opening movement of the chute 35 which is permitted can be varied by changing the relative proportions and shape of the two regions 39*a*, 39*b* of the leading edges. In particular, the angle of the second region 39*b* relative to the front wall can be varied to alter the permitted range of opening movement of the chute 35.

It can be seen that in a first aspect of the invention, the preferred embodiment provides a container having a chute in one end wall which can be formed from a unitary blank and filled through the end of the container in which the chute is formed. This reduces the need for the container to be inverted during assembly and/or filling and is particularly beneficial for machine assembly and filing. The preferred embodiment also provides a container that has a simple and reliable means of limiting the opening movement of the chute in accordance with a second aspect of the invention.

The container is suitable for dispensing a wide variety of items but is particularly suitable for dispensing items in tablet or pellet form or the like. The container 11 is especially suitable for dispensing confectionery items including chewing gum pellets, mints and the like.

It is of course to be understood that the invention is not intended to be restricted to the details of the above embodiment, which is described by way of example only. For example, whilst is advantageous that the container be formed from a single unitary blank, it will be appreciated that the container could be formed from two or more separate pieces of foldable material.

The invention claimed is:

1. A confectionery container constructed from one or more pieces of foldable material, the container having a first end closed by a wall which incorporates at least part of a dispensing chute movable between an open position for the dispensing of items and a closed position for the containment of items within the container, the first end wall comprising two or more end closure flaps arranged such that they can be assembled into the first end wall after the items to be contained and dispensed have been introduced into a partially formed container through the first end, the container further comprising a first pair of opposing side walls and a second pair of opposing side walls, wherein each of the first pair of opposing side walls has a first inner panel and a first outer panel, each of the second pair of opposing side walls has a second inner panel and a second outer panel, and one of the end closure flaps is attached by a fold line to the first inner panel of one of the first pair of opposing side walls and another of the end closure flaps is attached by a fold line to the first inner panel of the other of the first pair of opposing side walls, wherein said inner panel of one of the second pair of opposing side walls is between said inner panels of said first pair of opposing side walls and separated from said inner panels of said first pair of opposing side walls by a pair of side wall fold lines and said two or more end closure flaps extend beyond said pair of side wall fold lines.

2. A confectionery container as claimed in claim 1, in which the chute comprises a base and two chute side walls which project inwardly from opposing sides of the base, the base forming at least part of the first end wall, one of said two chute side walls is foldably attachable to one of said end closure flaps, and another of said two chute side walls is folbably attachable to another of said end closure flaps.

3. A confectionery container as claimed in claim 2, wherein at least one side chute wall is arranged to contact a side wall of the container to limit movement of the chute in the opening direction.

4. A confectionery container as claimed in claim 3, in which the limiting relationship is provided by the configuration of the at least one chute side wall.

5. A confectionery container as claimed in claim 4, in which the at least one chute side wall has a leading edge for cooperating with said side wall of the container.

6. A confectionery container as claimed in claim 5, in which the leading edge comprises a first curved region extending from an end adjacent the base of the chute to an intermediate position part way along the edge and a second region having a different profile extending beyond the intermediate position towards a distal end, the arrangement being such that, in use when the chute is opened, the first curved region moves past an inner surface of the side wall of the container over an initial permitted range of movement of the chute in the opening direction, the second region of the edge subsequently contacting the inner surface of the side wall of the container to limit the opening movement of the chute beyond the permitted range.

7. A confectionery container as claimed in claim 6, in which the second region of the leading edge is generally linear.

8. A confectionery container as claimed in claim 7, in which the generally linear second region is configured such that when the chute is closed it is angled inwardly away from the side wall of the container.

9. A confectionery container as claimed in claim 8, in which the leading edge is configured so that when the chute is at the limit of its permitted movement in the opening direction, the second region extends generally parallel to and in contact with the side wall of the container.

10. A method as claimed in claim 3, in which the assembly and filling of the container is carried out by machine.

11. A confectionery container as claimed in claim 2, in which both chute side walls comprise a leading edge which cooperates with the side wall of the container to limit opening movement of the chute.

12. A confectionery container as claimed in claim 2, in which the base of the chute comprises only part of the first end wall and is connected with the remainder of the first end wall by a fold line about which the chute pivots between the open and closed positions.

13. A confectionery container as claimed in claim 2, in which each chute side wall comprises a portion of one of the inner panels.

14. A confectionery container as claimed in claim 13, in which each panel portion is separably connected with the remainder of its respective inner panel by means of perforations.

15. A confectionery container as claimed in claim 13, in which the remaining portions of the inner panels are adhered to their respective outer panels.

16. A confectionery container as claimed in claim 13, in which each panel portion is connected with a part of a respective one of the end closure flaps which forms the base of the chute by a fold line.

17. A confectionery container as claimed in claim 1, in which the container is shaped like a rectangular prism and the first pair of opposing side walls are wider or longer than the second pair of opposing side walls.

18. A confectionery container as claimed in claim 1, in which the container and chute are formed integrally from a unitary blank.

19. A confectionery container as claimed in claim 1, wherein said first end wall extends beyond the first inner panel and said first end wall extends beyond the second inner panel forming a lip.

20. A confectionery container as claimed in claim 1, further including a second end wall opposing said first end wall, said first end wall is longer then said second end wall.

21. A blank for forming a confectionery container constructed from one or more pieces of foldable material, the container having a first end closed by a wall which incorporates at least part of a dispensing chute movable between an open position for the dispensing of items and a closed position for the containment of items within the container, the first end wall comprising two or more end closure flaps arranged such that they can be assembled into the first end wall after the items to be contained and dispensed have been introduced into a partially formed container through the first end, the container further comprising a first pair of opposing side walls and a second pair of opposing side walls, wherein each of the first pair of opposing side walls has a first inner panel and a first outer panel, the each of second pair of opposing side walls has a second inner panel and a second outer panel, and one of the end closure flaps is attached by a fold line to the first inner panel of one of the first pair of opposing side walls and another of the end closure flaps is attached by a fold line to the first inner panel of the other of the first pair of opposing side walls, wherein said inner panel of one of the second pair of opposing side walls is between said inner panels of said first pair of opposing side walls and separated from said inner panels of said first pair of opposing side walls by a pair of side wall fold lines and said two or more end closure flaps extend beyond said pair of side wall fold lines.

22. A blank as claimed in claim 21, the blank comprising a pair of end closure flaps attached by means of fold lines with panel portions for forming at least part of opposing side walls of the container, the end closure flaps forming at least part of the first end wall of the container when the container is assembled.

23. A blank as claimed in claim 22, the blank comprising panel portions which form the side walls of the chute.

24. A blank as claimed in claim 21, in which each panel portion is connected by a fold line with one of the end closure flaps.

25. A blank as claimed in claim 24, in which at least one of the panel portions has a leading edge for cooperating with an inner surface of a side wall of the finished container to limit opening movement of the chute.

26. A blank as claimed in claim 25, in which the, or each, leading edge has a first curved region extending from an end adjacent the end closure flap to an intermediate position part way along the edge and a second region having a different profile extending beyond the intermediate position towards a distal end.

27. A blank as claimed in claim 26, in which the second region of the leading edge is generally linear.

28. A blank as claimed in claim 23, in which each panel portion is part of an inner panel forming a side wall of the assembled container and the blank further comprises outer panels which are arranged to overlie the inner panels when the container is assembled.

29. A blank as claimed in claim 28, in which each panel portion is separably connected with a remaining portion of its inner panel by means of perforations.

30. A blank as claimed in claim 29, in which each inner panel comprises a region of adhesive which covers at least part of an outer surface of the remaining portion.

31. A blank as claimed in claim 28, in which the blank comprises a series of eight panels connected by fold lines between adjacent panels, the arrangement being such that the panels can be folded about the fold lines to form two pairs of opposing side walls, each side wall having an inner panel and an outer panel overlying its respective inner panel.

32. A method of constructing a confectionery container from one or more pieces of foldable material, the method comprising:

providing the container blank having a first inner side wall, a second inner sidewall, a panel between said first inner side wall and said second inner side wall defined by score lines separating said panel from said first inner side wall and said second inner side wall, a first end and a second end, wherein said first end opposes said second end, the first end closed by a wall which incorporates at least part of a dispensing chute movable between an open position for the dispensing of items and a closed position for the containment of items within the container, wherein the first end wall comprises two or more end closure flaps, wherein said two or more end closure flaps extend beyond said fold lines;

assembling the container to form all the walls of the container except the first end wall, such that the partially formed container defines a receptacle into which the contents can be inserted through the opened first end; and subsequently assembling the end flaps to close the first end, wherein.

33. A method as claimed in claim 32, in which the partially formed container comprises four side walls and a second end wall at the end of the container opposite from the first end wall.

34. A method as claimed in claim 33, in which the method further comprises introducing items to be contained and dispensed into the partially formed container before the end closure flaps are assembled to close the first end.

35. A method as claimed in claim 34, in which during the assembly and filling process, the first end remains uppermost at least until the first end wall has been formed.

36. A method as claimed in claim 32 in which the container is formed from a single unitary blank.

37. A method as claimed in claim 36, the method comprising folding the blank to form two pairs of opposing side walls and securing in position; folding further end closure flaps to close a second end of the container opposite from the first end and securing in position;

introducing items to be contained and dispensed into the partially formed container through the open first end; subsequently folding the first end closure flaps and securing in position to close the first end.

38. A method as claimed in claim 32, in which the first end wall of the container further comprises an end closure tab connected by means of a fold line with a panel forming at least part of a side wall of the container, and the step of closing the first end includes folding the end closure tab into position.

* * * * *